US006398205B1

(12) United States Patent
Nakamura et al.

(10) Patent No.: US 6,398,205 B1
(45) Date of Patent: Jun. 4, 2002

(54) SHEET FEEDER UNIT

(75) Inventors: Yasuo Nakamura, Toyokawa; Haruhiko Hori, Okazaki, both of (JP)

(73) Assignee: Minolta Co., Ltd., Osaka (JP)

( * ) Notice: Subject to any disclaimer, the term of this patent is extended or adjusted under 35 U.S.C. 154(b) by 321 days.

(21) Appl. No.: 08/990,295

(22) Filed: Dec. 15, 1997

(30) Foreign Application Priority Data

Dec. 25, 1996 (JP) ..... 8-346011

(51) Int. Cl.[7] ..... B65H 3/52

(52) U.S. Cl. ..... 271/18; 271/124; 271/161; 271/167

(58) Field of Search ..... 271/121, 124, 271/161, 167

(56) References Cited

U.S. PATENT DOCUMENTS 4,192,497 A * 3/1980 Perun et al. ..... 271/18
4,395,036 A * 7/1983 Bergman et al. ..... 271/171
5,163,668 A * 11/1992 Winship et al. ..... 271/121
5,190,277 A * 3/1993 Rahman et al. ..... 271/35
5,956,158 A * 9/1999 Pinzarrone et al. ..... 358/474
5,971,389 A * 10/1999 Golicz et al. ..... 271/34

FOREIGN PATENT DOCUMENTS

| | | |
|---|---|---|
| EP | 0694490 | 1/1996 |
| EP | 0694491 | 1/1996 |
| EP | 0697358 | 2/1996 |
| JP | 07-196186 | 8/1995 |

* cited by examiner

*Primary Examiner*—Christopher P. Ellis
*Assistant Examiner*—Michael E. Butler
(74) *Attorney, Agent, or Firm*—Sidley Austin Brown & Wood LLP

(57) ABSTRACT

The pile of cut sheets (11) are fed one by one, being separated by a friction member (33) which is backed away by a cut sheet (11) advanced thereto by the action of a feeding roller (31). The static friction coefficient between the friction member (33) and a standard sheet of fine paper is set to be 1.0 to 1.5, so as to provide enough amount of frictional force to the interface between the friction member (33) and the cut sheets (11) to ensure the separation of the cut sheets (11).

18 Claims, 11 Drawing Sheets

SHEET FEEDER UNIT

BACKGROUND OF THE INVENTION

1. Technical Field of the Invention

The present invention relates to a sheet feeder unit which supplies cut sheets set in a pile thereon by a feeding roller being contacted to the cut sheets from one side thereof, and particularly to a sheet feeder unit which is capable of separating cut sheets to be supplied one after another by a frictional force generated when a leading end of the cut sheet is pushed forward to contact with a friction member which is supported at one end thereof and extended toward a conveying path of the cut sheet. The present invention may be employed for feeding a plurality of piled cut sheets one by one in various appliances such as a copying machine, printer, facsimile machine, or image reading apparatus.

2. Description of Related Art

Japanese published unexamined patent application No.7-196186 discloses the like of such sheet feeder unit, which is shown in FIG. 11. The feeder unit according to this prior art has a friction member 133 rotatably supported at its lower end by a shaft 132 to be able to stand upright and tilt, and configured to be rectangular when viewed from front. Each time a feeding roller 131 is rotated round, an uppermost cut sheet 111 is pushed forward so that a whole width of a leading end of the cut sheet 111 comes into frictional contact with the friction member 133 and causes the same to back away against a rebounding force of a spring 134 as shown by phantom lines in FIG. 11. The cut sheet 111 is thereby separated from the other and prevented from being supplied one upon another.

In order to assure the separation of cut sheets from each other, the angle $\alpha$ made by a surface of the friction member 133 and an uppermost cut sheet 111 is set within the range of 55° to 85°. The above mentioned published application also teaches a friction member made of an elastic sheet and fixed at its lower end with the same angular condition as described above, instead of rotatable support by the shaft 132.

The friction member of such configuration, however, requires a very fine adjustment to successfully separate the cut sheets. According to an experiment conducted by the inventors of the present invention, the rebounding force of the spring 134 toward its initial position should be set weak to prevent residual deformation of the cut sheet caused by the friction member 133. On the other hand, the rebounding force should be strong enough to increase the frictional force between the cut sheet 111 and the friction member 133 so as to ensure the separation. It is difficult to satisfy both of these contradictory conditions. Moreover, the resiliency of cut sheets varies depending on their quality and thickness, causing differences in frictional resistance even with the use of the same friction member.

Also, the friction member 133 in this prior art arrangement is disposed downstream in a feeding direction and away from a nipping position where the feeding roller 131 presses and pushes the cut sheet 111 forward. The cut sheet, when contacted against the friction member 133, is warped and separated from the other. Since the friction member 133 is distanced from the feeding roller 131 widely enough to allow the cut sheet 111 to flexibly deform therebetween, the cut sheet 111 can easily escape from the friction member 133 which is being tilted backward. This configuration helps to prevent residual deformation of the cut sheets 111 irrespective of their thickness.

Still, the sheet feeder unit of this prior art is not fully capable of stably separating cut sheets 111 and sometimes supplies the cut sheets in plural one upon another for the following reasons. Since the friction member 133 has an even surface against which the cut sheet 111 is contacted, the more the leading end of the cut sheet 111 pushes the friction member 133 and approaches a free end thereof, the more the contacting angle therebetween widens, to let the cut sheet 111 to easily slip, causing the frictional force to become less than a desired degree. The cut sheets 111 thus slip through the friction member 133 from time to time without being fully separated from each other. Although the setting of the angle between the cut sheet 111 and the friction member 133 helps to prevent such slippage to some extent, it is not enough to fully prevent faulty feeding of cut sheets, especially of a less resilient type due to their quality or thickness.

BRIEF SUMMARY OF THE INVENTION

In view of the foregoing, it is a primary object of the present invention to provide a sheet feeder unit capable of successfully separating and supplying cut sheets of any type.

To accomplish the above said object, the sheet feeder unit of the present invention comprises a support member on which a pile of sheets are loaded; a feeding roller for sending out the sheets in a sheet feeding direction, which contacts to one side of the sheets piled on the support member; and a friction member being supported at one end and having a frictional force yielding portion which is capable of contacting a leading end of the cut sheets in a sheet feeding path, the frictional force yielding portion having a static friction coefficient of 1.0 to 1.5 with respect to the sheets piled on the support member.

According to the arrangement of the present invention, the leading edge of the cut sheets is contacted by a friction member with sufficient frictional force until it is passed through and off of the tip of the friction member, whereby the object of stably feeding cut sheets one by one irrespective of their type is accomplished.

Other and further objects, features and advantages of the invention will appear more fully from the following description.

BRIEF DESCRIPTION OF THE DRAWINGS

FIG. 5 is an explanatory view for theoretically explaining the separation of cut sheets by the friction member according to the present invention, in which

DETAILED DESCRIPTION OF THE INVENTION

Preferred embodiments of the present invention will be hereinafter described in conjunction with the accompanying drawings.

<First Embodiment>

Figure 2A:
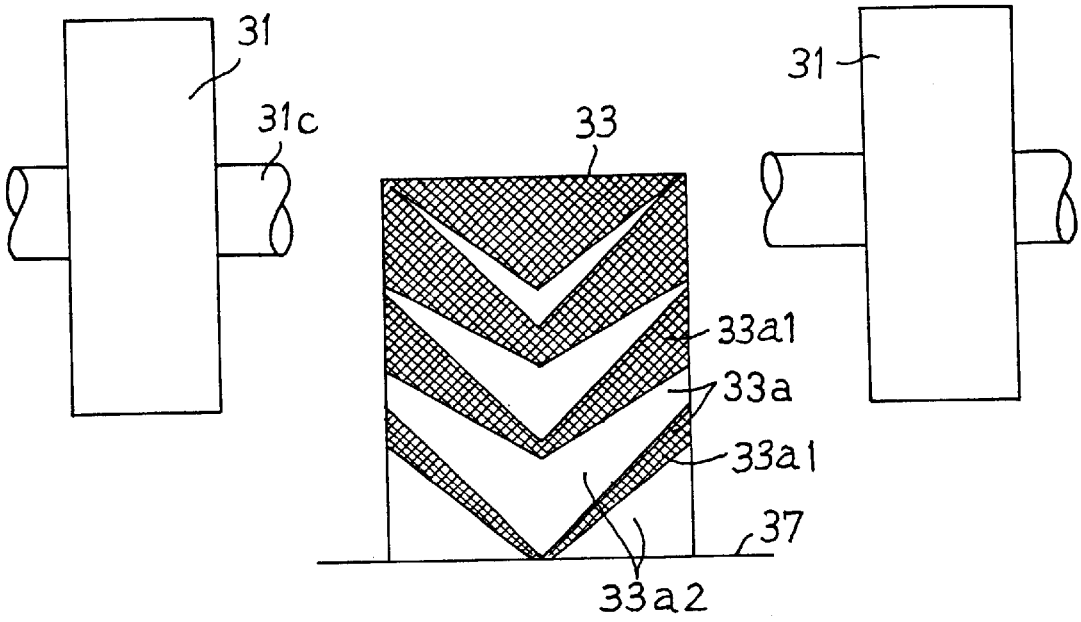
FIG. 2A is a front view showing primary parts of the sheet feeder unit of FIG. 1.
Figure 2B:
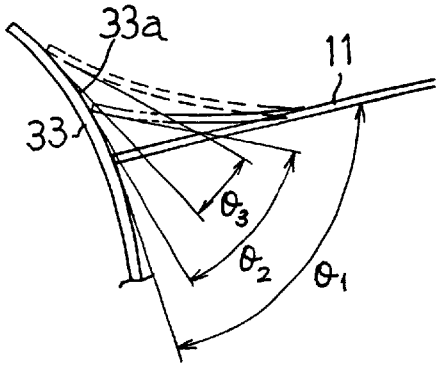
FIG. 2B is a side elevation view thereof.
Figure 3:
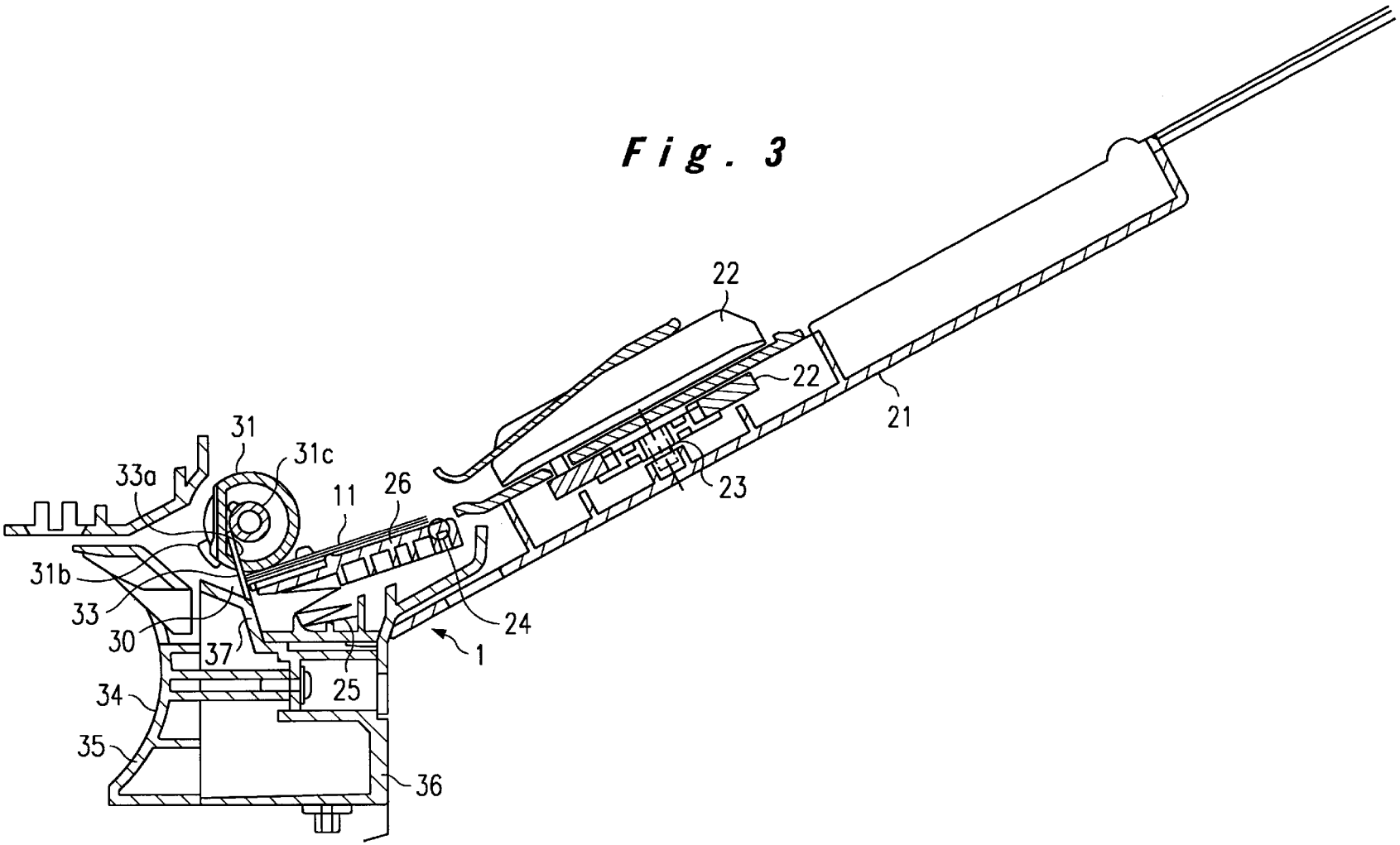
FIG. 3 is a sectional view of an entire body of the sheet feeder unit of FIG. 1.
Figure 4:
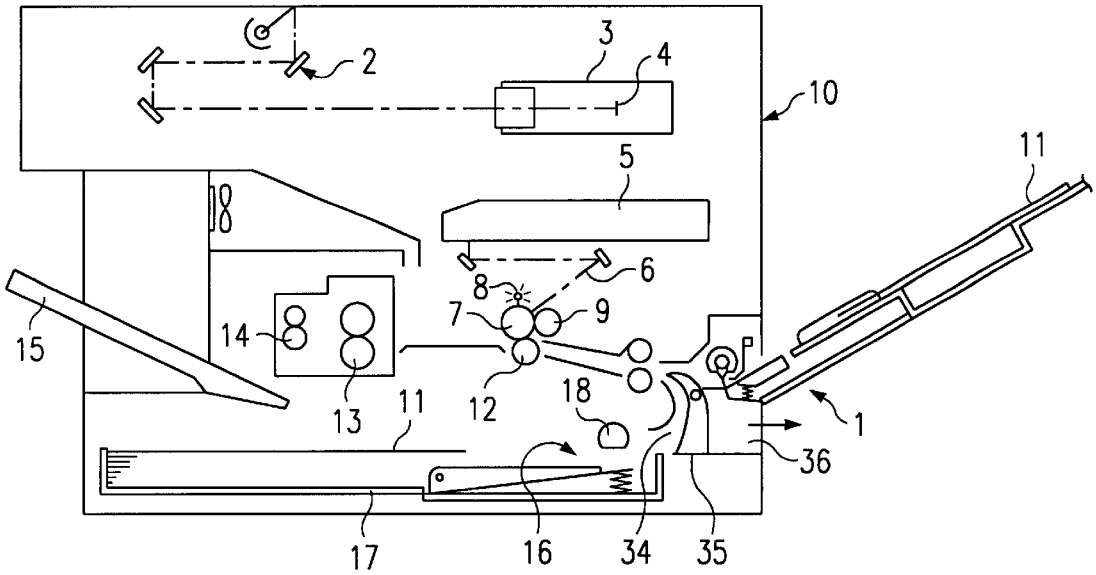
FIG. 4 is a schematic view showing the structure of a copying machine in which the sheet feeder unit of FIG. 1 is incorporated.

A first embodiment of the present invention is shown in FIGS. 1 to 4, and implemented as a sheet feeder unit 1 for supplying recording sheets in a digital copying machine 10 as shown in FIG. 4. An original document which is either manually placed on a platen glass or automatically fed by a document feeding apparatus (not shown) is scanned by a scanning optical system 2. A scanned image is formed in an image sensor 4 in an image reader unit 3, which is converted into electrical image signals to be transmitted to a print head 5. The print head 5 projects out a laser beam 6 modulated by the image signals onto a photosensitive drum 7 to expose the image.

The photosensitive drum 7 is positioned substantially at the center of the main body of the copying machine 10, and its surface is evenly charged by a charging brush 8 for the exposure of the image. An electrostatic latent image formed on the charged surface of the photosensitive drum 7 is developed with toners in a developing unit 9 to be a visible image, which is transferred onto a cut sheet 11 conveyed from the sheet feeder unit 1 by a transfer roller 12 or the like. The cut sheet 11 is then carried to a fixing unit 13 to fix the transferred image thereon, after which the cut sheet 11 is discharged onto a discharge tray 15 directly or being guided by a discharge roller 14.

The copying machine 10 is provided with a sheet feeding apparatus 16 at its bottom for supplying cut sheets 11 of a standardized type or sheets commonly used, which comprises an extractable feeder cassette 17 and a feeding roller 18 mounted in the main body of the copying machine 10 for pushing the sheets forward. While the sheet feeding apparatus 16 is built in the copying machine 10, the sheet feeder unit 1 is a cassette type sheet feeder on which recording sheets are manually placed, and thus projected from a side of the copying machine 10. The sheet feeder unit 1 is intended for use when it is desired to feed one or plurality of cut sheets 11 of different quality or size which are not prepared in the main body of the copying machine 10.

Referring to FIG. 3, the sheet feeder unit 1 has a pair of side guides 22 provided at both sides of its feeder tray 21, the positions of which are adjustable according to a width of the cut sheets 11 corresponding to various different sizes thereof. Both side guides 22, 22 are connectively moved with each other by a linking gear 23 within the feeder tray 21, so that the cut sheet 11 of any size is always centered on the feeder tray 21. The sheet feeder unit 1 of such cassette type is suitable for various kinds of cut sheets 11 including postcards, plastic sheets for OHP, very thin sheets, or other unexpected types of sheets.

The sheet feeder unit 1 is desired to have high sheet feeding performance and to be capable of feeding any type of cut sheets 11, while its sheet feeding mechanism must be simple and compact, as the cassette type sheet feeder is one of fittings which are not very frequently used. While being highly capable of stably feeding any types of cut sheets 11, the sheet feeder unit 1 of the first embodiment is as simply constructed as the above mentioned prior art, in which the outermost cut sheet 11 pushed forward by the feeding roller 31 comes to contact with and causes the friction member 33 to back away, which prevents the other cut sheets from proceeding with the outermost cut sheet 11 by the frictional contact therebetween. It will be understood that the present invention may be applied to a sheet feeding apparatus commonly used and built in the copying machine, an automatic sheet feeder, or to any other appliances.

The feeding roller 31 of the sheet feeder unit 1 is disposed on a side face of the main body of the copying machine 10. The feeder tray 21 extends laterally and upwardly from a base 36 with an outer guide 35 which defines a sheet conveying path 34 for guiding a cut sheet 11 fed from the sheet feeding apparatus 16 toward the photosensitive drum 7. The base 36 is connected to the main body of the copying machine 10 by a hinge (not shown) at its one side, around which the base 36 is rotated together with the feeder tray 21 to open/close the sheet conveying path 34 for removing jammed paper.

The feeder tray 21 has a plate 26 which is rotatably supported by a shaft 24 at its one end and urged upward by a spring 25. The plate 26 presses the pile of cut sheets 11 on the feeder tray 21 toward the feeding roller 31, which pushes the outermost or uppermost cut sheet 11 forward by its rotation. The surface of the feeding roller 31 is made of rubber such as ethylene propylene diene monomer (EPDM) or the like to provide an appropriate amount of frictional force. The material of the feeding roller 31 is of course not limited to the one mentioned above.

The feeding roller 31 is configured to be semicircular in cross section, the cutaway flat portion of which is usually faced with the cut sheets 11, and the feeding roller 31 is rotated round to cause its semicircular periphery to contact with the cut sheet 11 to send it out. When the sheets are not to be fed, a cam 31*b* which is rotated in synchronism with the feeding roller 31 is contacted with a cam follower 26*a*, which presses down the plate 26 against the force of the spring 25, to bring the cut sheets 11 apart from the feeding roller 31, so that the pile of cut sheets 11 can be readily placed at a predetermined location on the feeder tray 21 by hand where the cut sheets 11 come to contact with the friction member 33, or removed the same way therefrom.

At the time of feeding sheets, when the feeding roller 31 is started to rotate, the cam 31*b* comes apart from the cam follower 26*a* at the same time or slightly after the cutaway portion of the feeding roller 31 comes out of opposition to the cut sheets 11. The plate 26 being freed is thus pushed upward by the spring 25 to press the cut sheets 11 onto the periphery of the rotating feeding roller 31.

The friction member 33 of this embodiment is made of an elastic sheet, so that the friction member 33 can be elastically deformed to warp when the cut sheet 11 is sent out by the feeding roller 31. The feeding member stops the cut sheets 11 except the uppermost one, thereby separating the cut sheets 11 from each other by the frictional contact therebetween and supplies the cut sheets one by one from the uppermost side thereof. For this reason, the friction member 33 is extended from the lowermost side of the pile of cut sheets 11 toward a conveying path 30 of the cut sheets, with its lower end fixedly connected to a support wall 37 standing upright under the conveying path 30 by any appropriate manners such as bonding or bolting.

The mechanism of how the friction member 33 separates the cut sheets can be theoretically and quantitatively explained by the combination of the backing away movement of the friction member 33 and partial deformation of the cut sheets as follows.

Figure 5A:
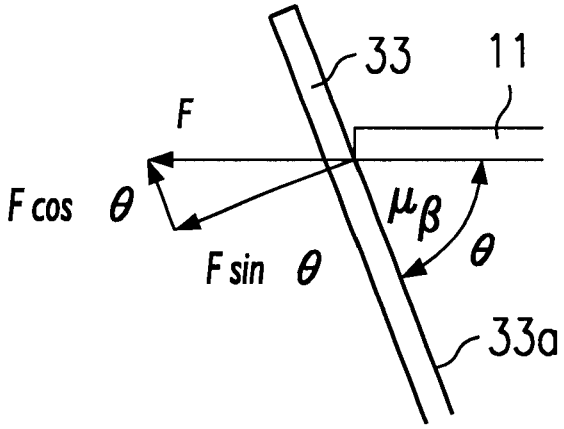
FIG. 5A is a sectional view.

FIG. 5A shows a state where the force F of proceeding cut sheet 11 balances the frictional force on the surface 33*a* of the friction member 33, which is expressed by an equation $$F \cos \theta = \mu_B \cdot F \sin \theta \quad (1),$$

where $\mu_B$ is a friction coefficient of the frictional surface 33*a* with respect to the cut sheet 11, and θ (fixed value) is the angle made between the cut sheet 11 and the frictional surface 33*a*. From above, the following relations are derived.

$$\mu_B \cdot \tan \theta < 1 \text{ (cut sheet proceeds)} \quad (2)$$

$$\mu_B \cdot \tan \theta \geqq 1 \text{ (cut sheet proceeds)} \quad (3)$$

Figure 5B:
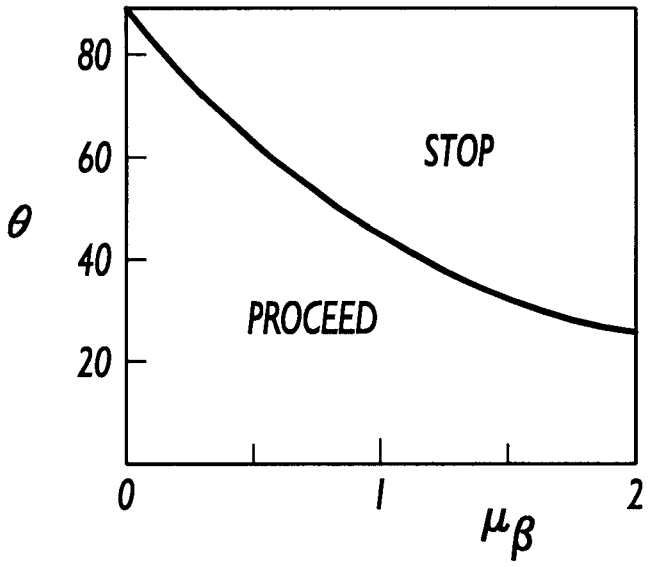
FIG. 5B is a graph showing a boundary condition whether the cut sheet stops or proceeds when contacted against the friction member.

FIG. 5B shows critical angles of contacting angle θ within the range of appropriate friction coefficient μB where the cut sheet 11 slips to proceed.

It can be seen from the above inequalities (2),(3) that, theoretically, whether the cut sheet 11 proceeds or not does not depend on the force F but on the values of the friction coefficient $\mu_B$ and the angle θ. Thus, if the $\mu_B$ is invariable, it is necessary to give a difference in the contacting angle θ between the outermost cut sheet 11 and the other cut sheets 11 with respect to the frictional surface 33*a*. In other words, the outermost cut sheet 11 can be separated by changing the contacting angle θ from the "STOP" area to the "PROCEED" area of the graph shown in FIG. 5B.

However, the cut sheets 11 are normally placed in a pile in tight contact with each other and there is virtually no difference in the angle θ made by each cut sheet 11 and the frictional surface 33*a*.

The friction member 33, while being pushed back by the advancing cut sheet 11, causes the outermost cut sheet 11 to curve by the frictional force of contact more than the other following cut sheets 11, so that the angle θ made by the outermost cut sheet 11 and the frictional surface 33*a* becomes much acuter than that of the other cut sheets 11 as shown in FIG. 2B, thus separating the cut sheets 11 from each other and allowing only the outermost cut sheet to pass through while stopping the others.

Nevertheless, it is still difficult to ensure that the cut sheets 11 are fed one by one without any residual deformation which may be caused by too much force from the friction member 33, because the resiliency of cut sheets varies depending on their type, quality, and thickness.

The friction member 33 in this embodiment may be, for example, made of a polycarbonate film with a thickness of 200 micrometers which may be available on the market, to provide enough restoring force. The frictional surface 33*a* is provided with a necessary friction coefficient by coating the surface of polycarbonate film with a material having a high friction coefficient such as urethane resin by a silk screen printing method or the like. The frictional surface 33*a* may preferably have about a 1.0 to 1.5 static friction coefficient with respect to standard fine paper. It is also preferable that the angle made by the frictional surface 33*a* and the uppermost cut sheet 11 is determined within the range of 90° to 120°. In this embodiment, the frictional surface 33*a* satisfying the above described conditions was simply achieved by coating the friction member with polyurethane resin by silk screen printing method using a screen of about 200 meshes, which was then finished by thermosetting treatment for 30 minutes at around 80° C.

The contacting angle between the cut sheet 11 and the frictional surface 33*a* becomes more and more acute from $\theta_1$ to $\theta_3$ as shown in FIG. 2B, as the cut sheet 11 approaches the tip of the friction member 33 in its forwarding movement. By having a static friction coefficient of 1.0 to 1.5 against a standard sheet of fine quality paper, the friction member 33 of the present invention can provide enough amount of contacting frictional force to separately supply the cut sheet 11 irrespective of its sort.

The coating of urethane resin is so provided that the proportion of coated areas 33*a*1 and uncoated areas 33*a*2 varies in a direction of contact between the friction member 33 and the cut sheet 11 as shown in FIG. 2A. This further enhances the ability of the friction member to separate any of various types of cut sheets, because a friction coefficient to satisfy the required conditions can be determined at each position of the friction member from the base side toward the distal side.

It is preferable to set the proportion of areas in such a way that the coated area 33*a*1 increases toward the distal side of the friction member 33, so that the friction member 33 can fully function up to its very distal end. More particularly, the coated area 33*a*1 of urethane resin may be provided in the shape of V or inverted V as shown in FIG. 2A to be strips of various density and width to change the proportion of coated and uncoated areas in a direction of frictional contact. The ratio of coated area 33*a*1 can be thereby successively changed from the base side to the distal side of the friction member 33 in bilateral symmetry, by which effective separation of cut sheets can be carried out in a bilaterally well-balanced and successive manner.

The proportion of coated area and uncoated area is preferably changed to satisfy the following conditions:

$$1/\mu_1 = \tan \theta_1$$

$$1/\mu_2 = \tan \theta_2$$

$$1/\mu_3 = \tan \theta_3$$

where $\theta_1$, $\theta_2$, $\theta_3$ are respectively the total friction coefficient at each interface between the cut sheet 11 and the frictional surface 33*a* where the entire width of the frictional surface 33*a* contact with the cut sheet 11.

Figure 1:
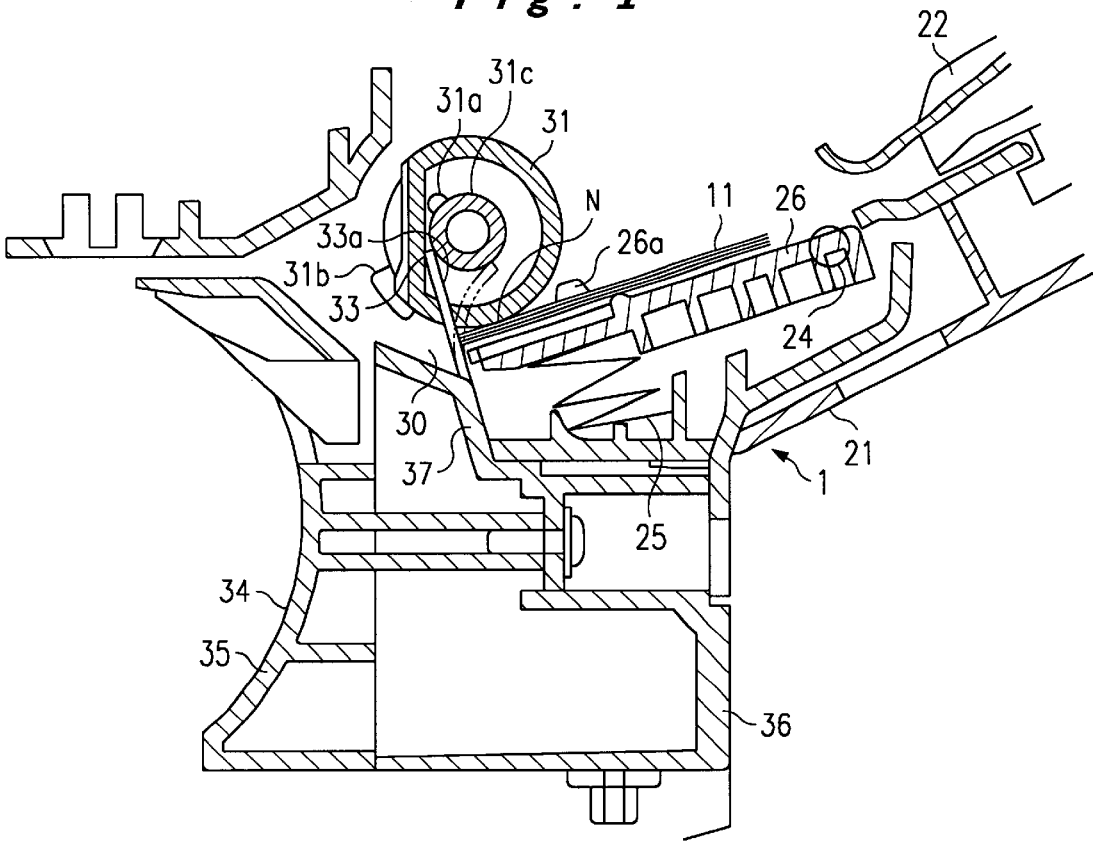
FIG. 1 is a sectional view showing primary parts of a sheet feeder unit according to a first embodiment of the present invention.

Furthermore, the frictional surface 33*a* is positioned within the area defined by the outside dimension of the feeding rollers 31 as can be seen from FIG. 1, where the cut sheet 11 comes to frictional contact with the friction member 33. The distance between the frictional surface 33*a* and a nipping position N where the feeding rollers 31 contact to advance the cut sheet 11 is much smaller than that of the prior art arrangement described above. The cut sheet 11 between the nipping position and the frictional surface 33*a* is restrained from being unfavorably deformed to ensure that the cut sheet 11 is received by the friction member 33 with an appropriate amount of frictional force, enhancing the performance of the friction member 33 and allowing it to be suitable for high-speed feeding. Favorable results were obtained by determining the angle of the friction member 33 in the manner described above.

When the feeding roller 31 is given one turn to send out one cut sheet 11 and the rear end of the cut sheet 11 is passed through the nipping position N, the friction member 33 becomes freed from the pressing force of the cut sheet 11 and returns to its initial position. Other cut sheets 11 following the previously fed cut sheet 11 are pushed back by the restoring force of the friction member 33 to prevent them from becoming obstructions to the succeeding sheet feeding. The friction member 33 with the prescribed angle condition successively accomplished such object.

<Second Embodiment>

Figure 6:
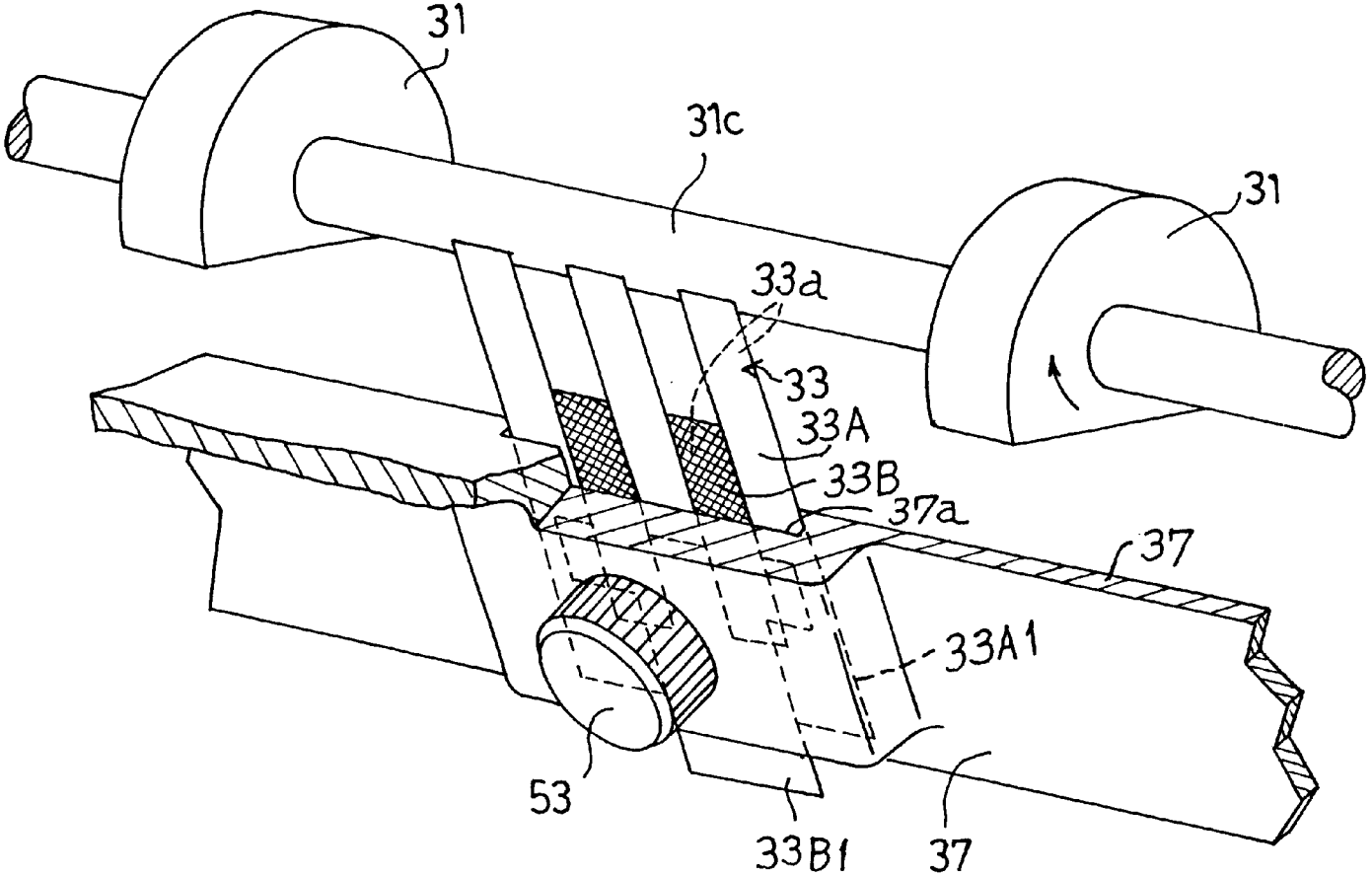
FIG. 6 is a perspective view showing primary parts of a sheet feeder unit according to a second embodiment of the present invention.
Figure 7:
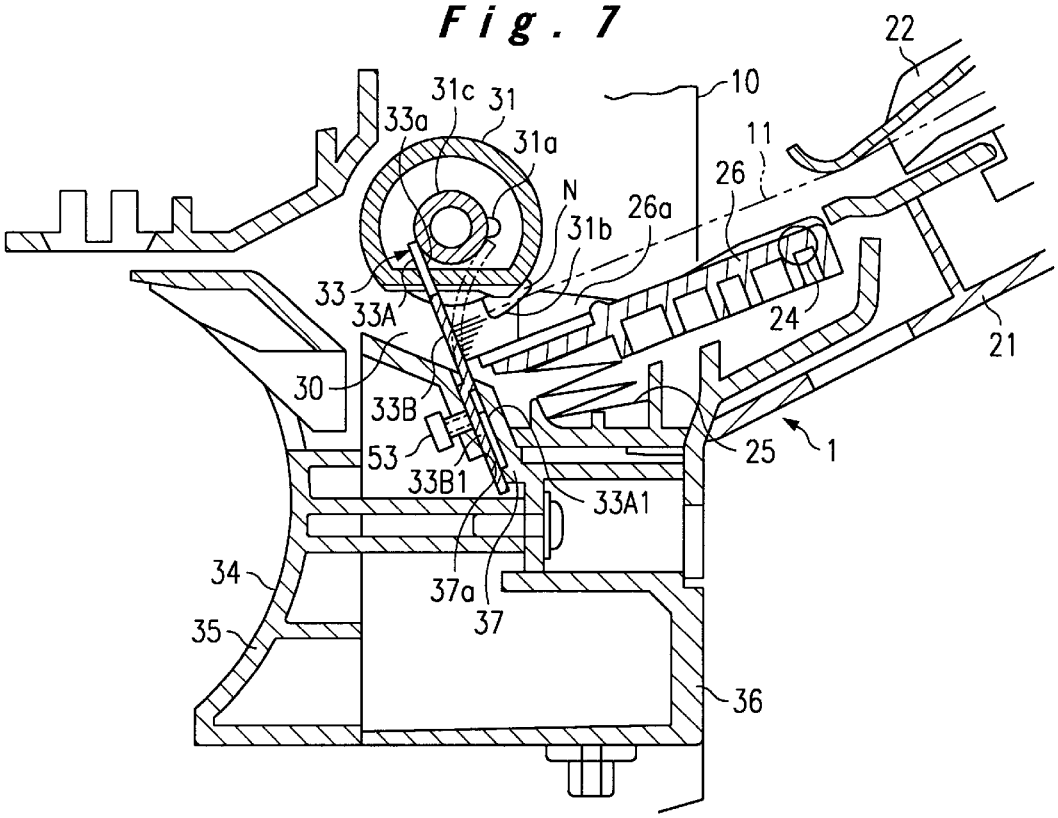
FIG. 7 is a sectional view showing primary parts of the sheet feeder unit of FIG. 6.

The friction member 33 of the second embodiment comprises first and second friction members 33A and 33B, respectively having different friction coefficients. The first and second friction members 33A and 33B are arranged alternatively side by side on an identical plane as shown in FIGS. 6 and 7. It is preferable to make the arrangement of the friction member bilateral, but the number and the arrangement may be variously set.

The friction members 33A, 33B, having different coefficients laterally constitute the frictional surface 33*a* in combination to provide a necessary friction coefficient as a whole friction member 33 at each position from the base side toward the distal side thereof Though not shown the surfaces of the friction members 33A, 33B are respectively coated to have a different friction coefficient, and the ratio of coated area may be varied as in the first embodiment.

The main friction members 33A which have longer contact area with the cut sheet 11 have their common base 33A1 being fixed in a slit 37*a* of the support wall 37 by bonding or the like, while the shorter sub friction members 33B have their common base 33B1 being fixed in the slit 37*a* by a screw 53 from behind, allowing for height adjustment by loosening the screw 53.

The length of the second friction member 33B can be thus adjusted in accordance with types of cut sheets or ambient conditions such as humidity which may greatly affect the separation characteristics of the friction member.

This position adjustment is made to change the amount of frictional force between the friction member 33 and the cut sheet 11 and provides the same effect as the angle change therebetween. Such position adjustment may be similarly made to a single friction member such as the one according to the prescribed first embodiment with the same effects.

Other elements and effects which are identical to those of the first embodiment are given the same numerals and will be described in no more detail.

The friction member 33 in both the first and second embodiments has been described as made of an elastic sheet, but the friction member 33 may also be implemented as a rigid material pivotally supported at its base end and given a rebounding force by a spring.

<Third Embodiment>

Figure 8:
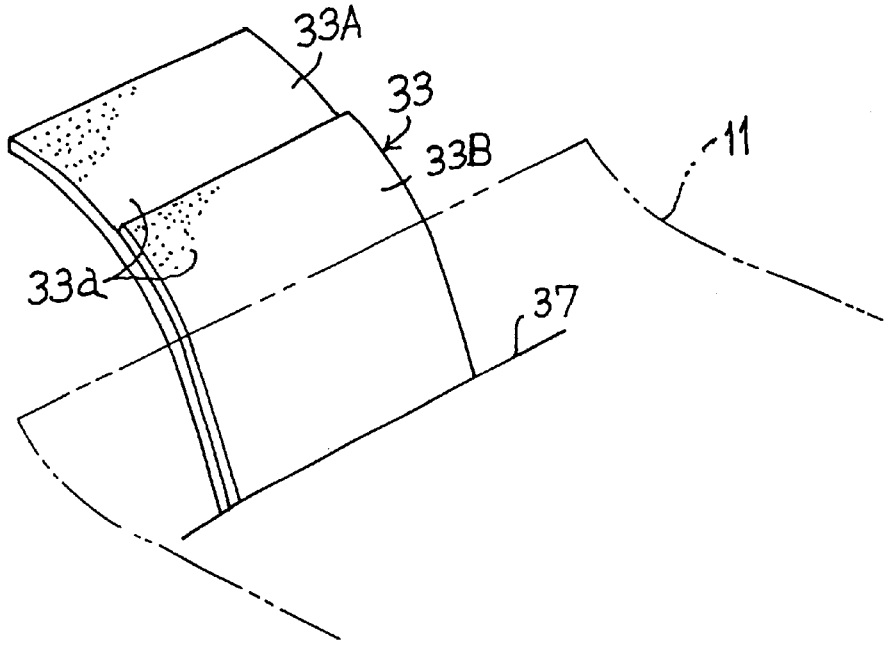
FIG. 8 is a perspective view showing primary parts of a sheet feeder unit according to a third embodiment of the present invention.
Figure 9:
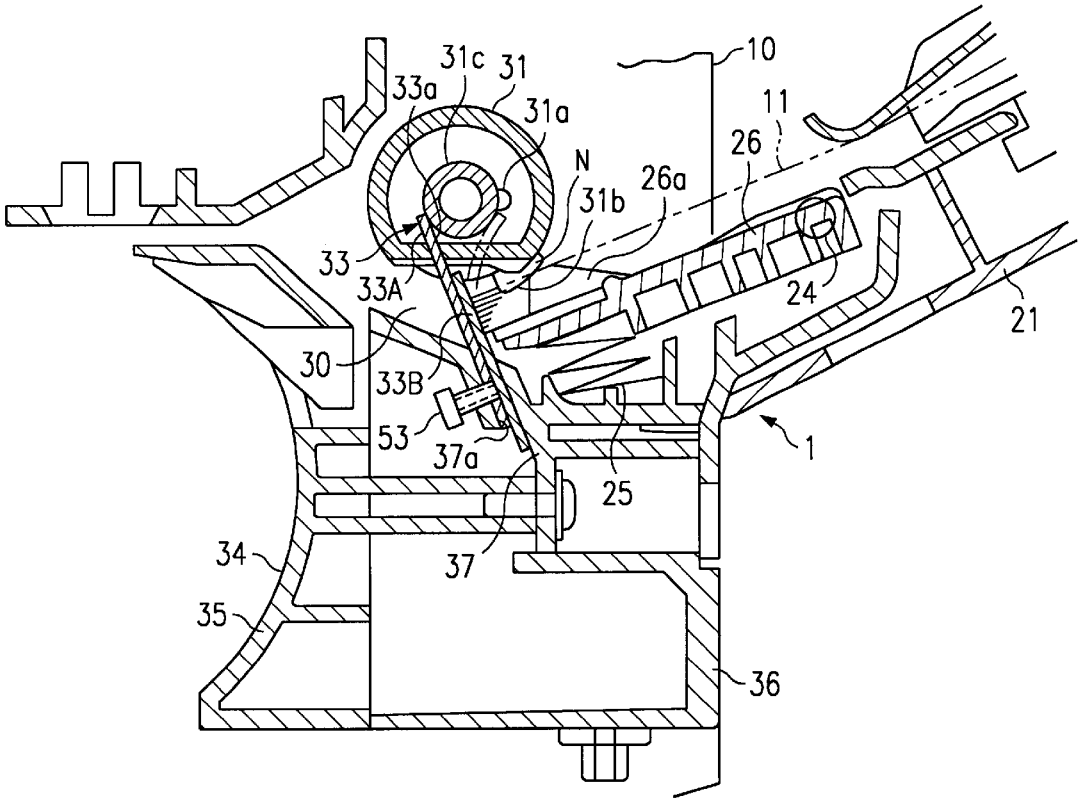
FIG. 9 is a sectional view showing primary parts of the sheet feeder unit of FIG. 8.

The friction member 33 of a third embodiment of the present invention comprises a first friction member 33A and a second friction member 33B which partly overlaps the first friction member 33A from the front side at the base end as shown in FIGS. 8 and 9. The first and second friction members 33A and 33B respectively have a different friction coefficient to construct the whole frictional surface 33*a* in combination which provides a friction coefficient at each different position of the friction member from the base side toward the distal side.

Though not shown, the surfaces of the friction members 33A, 33B are respectively coated to have a different friction coefficient, and the ratio of coated area may be varied as in the first embodiment.

The main friction member 33A which has longer contact area with the cut sheet 11 has its base 33A1 being fixed in a slit 37*a* of the support wall 37 by bonding or the like, while the shorter sub friction member 33B has its base 33B1 being fixed in the slit 37*a* by a screw 53 from behind, allowing for height adjustment by loosening the screw 53.

The length of the second friction member 33B can be thus adjusted in accordance with types of cut sheets or ambient conditions such as humidity which may greatly affect the separation capacity of the friction member.

This position adjustment is made to change the amount of frictional force between the friction member 33 and the cut sheet 11 and provides the same effect as the angle change therebetween.

Other elements and effects which are identical to those of the first embodiment are given the same numerals and will be described in no detail.

<Fourth Embodiment>

Figure 10:
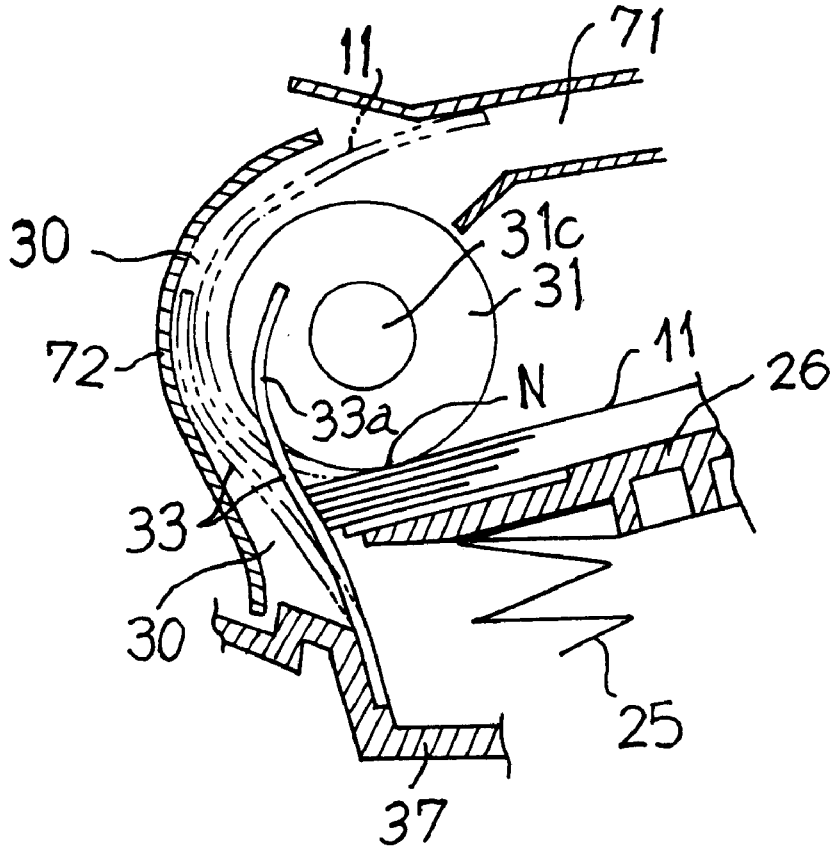
FIG. 10 is a sectional view showing primary parts of a sheet feeder unit according to a fourth embodiment of the present invention.
Figure 11:
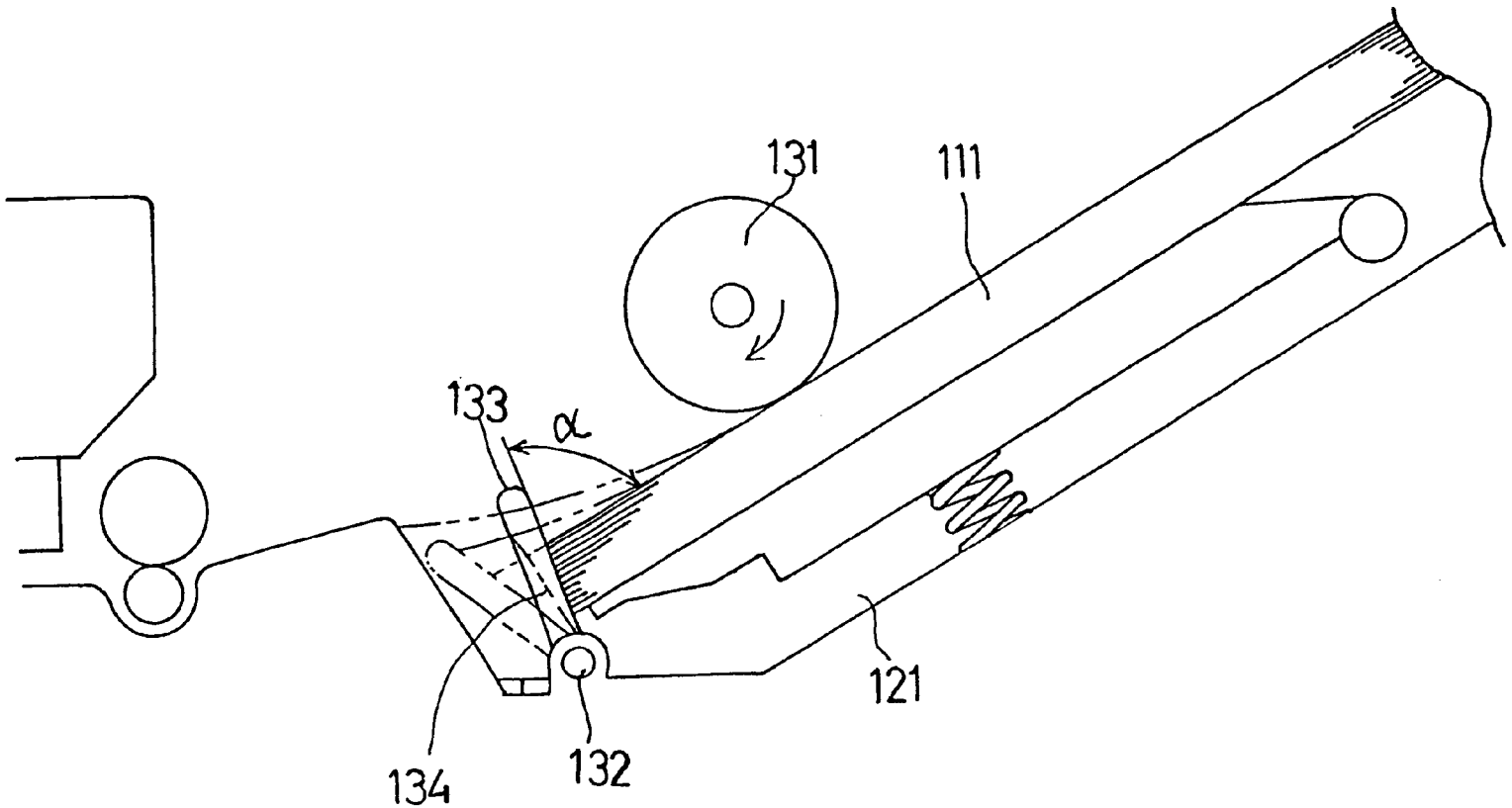
Fig. 11 Prior Art
FIG. 11 is a sectional view showing a conventional sheet feeder unit.

FIG. 10 shows a fourth embodiment of the present invention. The friction member 33 having a frictional surface 33*a* coated with urethane resin is fixedly connected to the support wall 37 to position within an area defined by the outside dimension of the feeding roller 31 just as in the first embodiment. The fourth embodiment differs from the other embodiments in that a guide 72 is provided behind the friction member 33 along the periphery of the feeding roller 31 for guiding a cut sheet 11 from the conveying path 30 toward the next sheet conveying path 71.

By this arrangement, the friction member 33 pushed back by the forwarding cut sheet 11 is stopped by the guide 72 there behind, which directs the cut sheet 11 along a direction of the frictional surface 33*a*. The cut sheet 11 can thus be smoothly passed toward the sheet conveying path 71 while tightly pressed against the frictional surface 33*a*, with the help of a bending force as the guide 72 causes the cut sheet 11 to forcibly change its direction.

The present invention has been described with respect to a sheet feeder unit which feeds sheets from the top side, but it is of course possible to apply the present invention to a sheet feeder unit sending out sheets from the bottom side. Also, the sheet feeder unit may not necessarily be a centering type as has been described, but the whole arrangement of the first embodiment may be applied to a sheet feeder unit which aligns the cut sheets on the feeder tray at one side thereof, since the cut sheets are unlikely to be fed obliquely with the provision of the feeding rollers in plurality.

The number and the arrangement of the feeding roller 31 and the friction member 33 are not limited to the ones described above and may be variously modified.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A sheet feeder unit comprising:

a support member on which a pile of cut sheets is loaded;

a feeding roller for sending out the sheets in a sheet feeding direction, which is in contact with one side of the cut sheets piled on the support member; and a friction member being supported at one end and having a frictional force yielding portion which is capable of contacting a leading end of the cut sheets in a sheet feeding path, the frictional force yielding portion having a static friction coefficient of 1.0 to 1.5 with respect to the cut sheets piled on the support member.

2. A sheet feeder unit according to claim 1, wherein the frictional force yielding portion is fabricated by coating a surface of the friction member with urethane resin.

3. A sheet feeder unit according to claim 2, wherein a proportion between an area coated with urethane resin and an area without any coating varies along a direction of frictional contact between the friction member and a cut sheet.

4. A sheet feeder unit according to claim 3, wherein the proportion of the area coated with urethane resin increases toward a distal end of the friction member.

5. A sheet feeder unit according to claim 3, wherein the area coated with urethane resin is formed in the shape of letter V or inverted V and arranged in such a way that the coated area varies in density and width along a direction of frictional contact between the friction member and a cut member.

6. A sheet feeder unit according to claim 1, wherein the friction member consists of a resilient sheet and comprises first and second friction members with respective frictional force yielding portions having different friction coefficients, the second friction member being arranged either side by side with the first friction member on an identical plane or superimposed on a front face of the first friction member from a base side to a middle part thereof.

7. A sheet feeder unit according to claim 6, wherein the second friction member is adjustable in position along a direction of frictional contact between the friction member and a cut sheet.

8. A method of feeding sheets comprising the steps of:

loading a plurality of cut sheets piled on one another onto a support member;

sending out a cut sheet into a sheet feeding direction with a feeding roller which is moved into contact with one side of the cut sheets loaded on the support member; and bringing a leading edge of the cut sheet being conveyed in the sending out step into contact with a frictional force yielding portion of a friction member, the friction member being supported at one end and the frictional force yielding portion having a static friction coefficient of 1.0 to 1.5 with respect to the cut sheets loaded on the support member.

9. A method of feeding sheets according to claim 8, wherein the frictional force yielding portion is fabricated by coating a surface of the friction member with urethane resin.

10. A method of feeding sheets according to claim 9, wherein a proportion between an area coated with urethane resin and an area without any coating varies along a direction of frictional contact between the friction member and the cut sheet.

11. A method of feeding sheets according to claim 10, wherein the proportion of the area coated with urethane resin increases toward a distal end of the friction member.

12. A method of feeding sheets according to claim 10, wherein the area coated with urethane resin is formed in the shape of letter V or inverted V and arranged in such a way that the coated area varies in density and width along a direction of frictional contact between the friction member and a cut sheet.

13. A method of feeding sheets according to claim 8, wherein the friction member consists of a resilient sheet and comprises first and second friction members with respective frictional force yielding portions having different friction coefficients, the second friction member being arranged either side by side with the first friction member on an identical plane or superimposed on a front face of the first friction member from a base side to a middle part thereof.

14. A method of feeding sheets according to claim 13, wherein the second friction member is adjustable in position along a direction of frictional contact between the friction member and a cut sheet.

15. A sheet feeder unit comprising:

a support member on which a pile of cut sheets is loaded;

a feeding roller for sending out the sheets in a sheet feeding direction, which is in contact with one side of the sheets piled on the support member; and a friction member being supported at one end and having a frictional force yielding portion which is capable of contacting a leading end of the cut sheets in a sheet feeding path, the frictional force yielding portion being a continuous member having a static friction coefficient with respect to the cut sheets piled on the support member which varies along a direction of frictional contact between the friction member and a cut sheet.

16. The sheet feeder of claim 15 wherein the static friction coefficient increases toward a distal end of the friction member.

17. The sheet feeder unit of claim 16 wherein the areas of increased static friction coefficient are formed in the shape of the letter V or inverted V and arranged in such a way that the area of increased static friction coefficient varies in density and width along the direction of frictional contact between the friction member and a cut sheet.

18. A sheet feeder unit comprising:

a support member on which a pile of cut sheets is loaded;

a feeding roller for sending out the cut sheets in a sheet feeding direction, which is in contact with one side of the cut sheets piled on the support member; and a friction member being supported at one end and having a frictional force yielding portion which is capable of contacting a leading end of the cut sheets in a sheet feeding path, the friction member consisting of a resilient sheet and including first and second friction members with respective frictional force yielding portions having different friction coefficients, the second friction member being arranged either side by side with the first friction member on an identical plane or superimposed on a front face of the first friction member from a base side to a middle part thereof, the second friction member being adjustable in position along a direction of frictional contact between the friction member and a cut sheet; and an adjustment knob to tighten the second friction member into a fixed orientation relative to the first friction member.

* * * * *

UNITED STATES PATENT AND TRADEMARK OFFICE

CERTIFICATE OF CORRECTION

PATENT NO. : 6,398,205 B1
DATED : June 4, 2002
INVENTOR(S) : Yasuo Nakamura et al.

It is certified that error appears in the above-identified patent and that said Letters Patent is hereby corrected as shown below:

Title page,
Item [30], Foreign Application Priority Data, delete "8-346011" and insert -- 8-346018 --.

Column 7,
Line 14, delete "thereof Though not shown", and insert -- thereof. Though not shown, --.

Signed and Sealed this

Fourth Day of March, 2003

JAMES E. ROGAN
*Director of the United States Patent and Trademark Office*